US005398040A

United States Patent [19]

Ogino et al.

[11] Patent Number: 5,398,040

[45] Date of Patent: Mar. 14, 1995

[54] ADAPTIVE CROSSHATCH SIGNAL GENERATOR

[75] Inventors: Masanori Ogino; Takeo Yamada; Miyuki Ikeda, all of Yokohama; Yoshihiro Arakawa, Fukui, all of Japan

[73] Assignee: Hitachi, Ltd., Tokyo, Japan

[21] Appl. No.: 359,270

[22] Filed: May 31, 1989 (Under 37 CFR 1.47)

[30] Foreign Application Priority Data

Jun. 1, 1988 [JP] Japan ..... 63-132654

[51] Int. Cl.[6] ..... G09G 1/00

[52] U.S. Cl. ..... 345/12; 345/14; 345/24; 348/181

[58] Field of Search ..... 358/10, 139, 141, 145, 358/148, 183; 328/14, 158, 187, 188, 189; 307/498, 261, 268; 340/732, 744, 745, 747, 789, 723, 734; 331/20; 315/364, 365, 367, 368; 345/12, 14, 24; 348/181

[56] References Cited

U.S. PATENT DOCUMENTS

| | | | |
|---|---|---|---|
| 2,978,540 | 4/1961 | Coate | 358/10 |
| 3,634,612 | 1/1972 | Stobbe | 358/10 |
| 4,045,815 | 8/1977 | Griffith | 340/732 |
| 4,093,960 | 6/1978 | Estes | 358/139 |
| 4,414,567 | 11/1983 | Berke et al. | 358/10 |
| 4,466,014 | 8/1984 | Wilensky et al. | 358/10 |
| 4,535,353 | 8/1985 | Turner | 358/139 |

*Primary Examiner*—Richard Hjerpe

*Attorney, Agent, or Firm*—Antonelli, Terry, Stout & Kraus

[57] ABSTRACT

An adaptive crosshatch signal generator includes a frequency detector for detecting a horizontal scanning frequency, a square calculator supplied with the detected output of the frequency detector, and a variable pulse width multivibrator controlled to have an output pulse width substantially in inverse proportion to the squared output. Longitudinal lines of a crosshatch signal are formed by the output pulses of the multivibrator. The crosshatch signal has a longitudinal line width which is always substantially equivalent to the distance between adjacent scanning lines and is generated by using a simplified configuration irrespective of input signal format.

17 Claims, 4 Drawing Sheets

90
91
92

(a)
(b)
Tw
(b)
TIME

TH
(a)
TIME

ADAPTIVE CROSSHATCH SIGNAL GENERATOR

BACKGROUND OF THE INVENTION

The present invention relates to a crosshatch signal generator, and in particular to an adaptive crosshatch signal generator capable of being suitably incorporated into a multiscan display device.

In recent years, needs for a multiscan display device adaptable to a plurality of scanning formats have increased. The term "multiscan display device" refers to a display device capable of making synchronization and deflection automatically follow video signals having scanning formats which are different from each other in horizontal scanning frequency and vertical scanning frequency.

It is desirable that a multiscan display device incorporates a crosshatch signal generator. Furthermore, it is convenient to use a crosshatch signal as a reference signal for adjusting color fringing distortion (resulting from noncoincidence of the three beams) and linearity distortion of a display device.

A conventional multiscan display device incorporates only a crosshatch signal generator for one representative scanning format. This results in a drawback that optimum adjustment is difficult or inconvenient in receiving a video signal having a different format.

SUMMARY OF THE INVENTION

An object of the present invention is to provide an adaptive crosshatch signal generator capable of generating crosshatch signals with respect to various scanning formats.

Another object of the present invention is to provide a crosshatch signal generator having a relatively simple configuration.

In accordance with one aspect of the present invention, the above described object is achieved by a crosshatch signal generator comprising a lateral line signal generator, a longitudinal line signal generator including a detector for horizontal scanning frequency $f_H$ and a pulse generator having an output pulse width changed in substantially inverse proportion to the square of the horizontal scanning frequency $f_H$, and a logic gate for providing the logical sum of outputs of the lateral line signal generator and the longitudinal line signal generator. In this configuration, a longitudinal line signal for generating longitudinal lines of a crosshatch pattern is generated by controlling the pulse width of a pulse generator comprising for example, a monostable multivibrator, so that the pulse width may be substantially in inverse proportion to $f_H^2$.

DESCRIPTION OF THE PREFERRED EMBODIMENTS

Figures 1A, 1B:
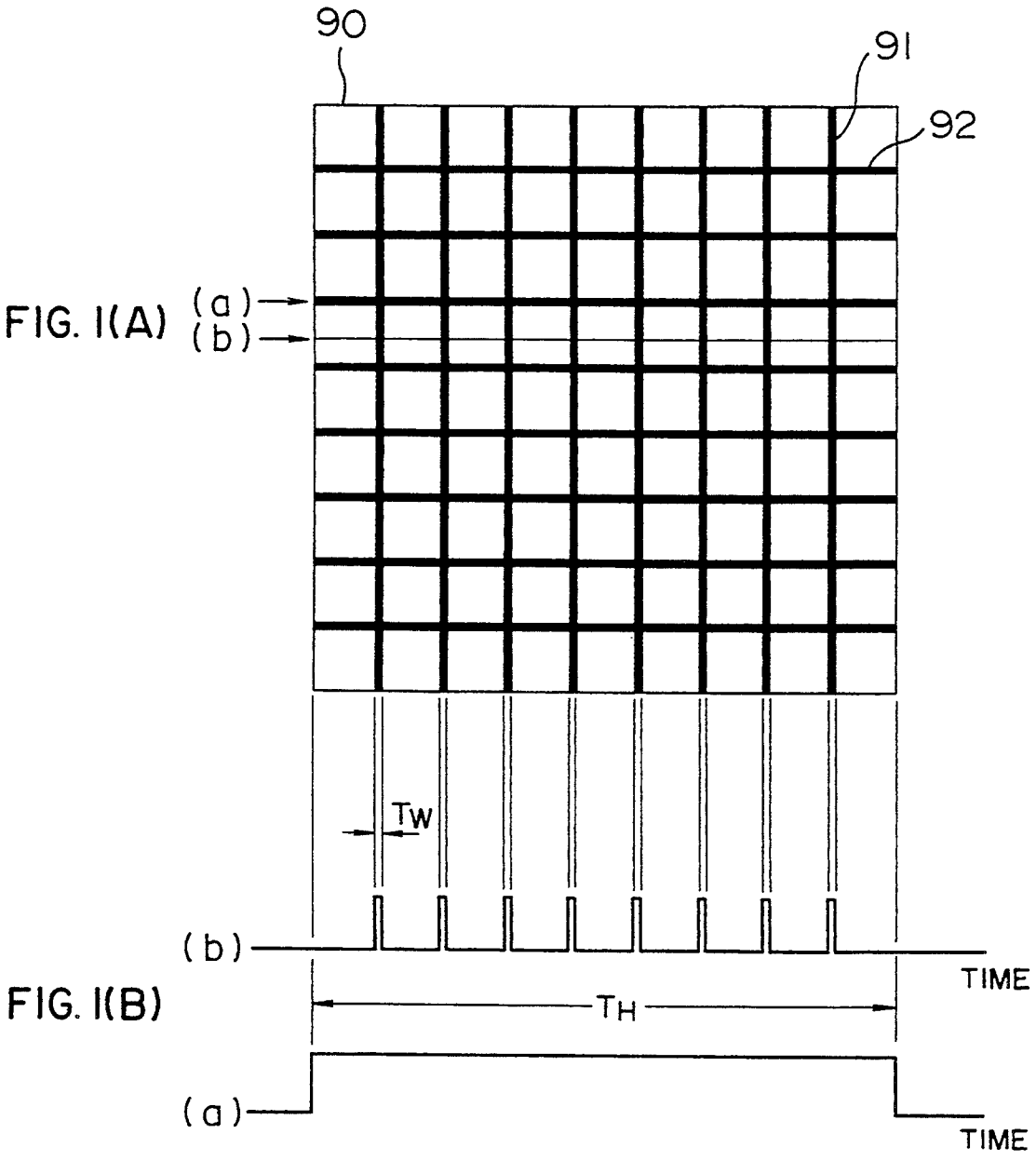
FIG. 1(A) shows a crosshatch pattern and FIG. 1(B) shows a crosshatch signal for displaying the crosshatch pattern on a display device.

Prior to description of preferred embodiments, the principle of the present invention will now be described by referring to the drawings.

FIG. 1(A) shows an example of a screen 90 of a display device whereon a crosshatch pattern having an aspect ratio of unity and comprising a plurality of longitudinal lines 91 and a plurality of lateral lines 92 is displayed. FIG. 1(B) shows a crosshatch signal corresponding to the crosshatch pattern illustrated in FIG. 1(A). In FIG. 1(B), (a) represents a lateral line signal for displaying a lateral line (a) of the cross-hatch pattern, and (b) represents a longitudinal line signal for displaying longitudinal lines crossing a line (b) when a beam is scanned along the line (b) of the crosshatch pattern. For convenience of explanation, the distance scale of FIG. 1(A) is shown so as to correspond to the time scale of FIG. 1(B). The line width of a lateral line is substantially equivalent to the width of one scanning line (i.e., the size of one picture element). Display of each lateral line is achieved by scanning the beam for one horizontal scanning interval $T_H$ at periods corresponding to lateral line intervals. That is to say, the lateral line signal for displaying a lateral line may be the signal (a) as shown in FIG. 1(B) which is in the on-state during one horizontal scanning interval $T_H$. Meanwhile, pulses having intervals of longitudinal lines and each having a width $T_W$ substantially corresponding to the scanning line width (i.e., width of one picture element) as shown in (b) of FIG. 1(B) are needed as the longitudinal line signal. Assuming that the aspect ratio of the screen is unity, such a value of $T_W$ can be obtained by making the value of $T_W$ w a value proportionate to $T_H/N$, where $T_H$ is one horizontal scanning interval and N is the number of scanning lines. That is to say, the number of picture elements, N, in the horizontal direction is equivalent to the number of picture elements in the vertical direction, when the aspect ratio is unity. Therefore, the pulse width $T_W$ corresponding to one picture element is obtained by dividing one scanning interval $T_H$ by N. Now, a case where the horizontal scanning interval $T_H$ is reduced, for example, to half as compared with the previous horizontal scanning interval is considered. In this case, the pulse width $T_W$ is required to be reduced to half as compared with the previous value. In the present invention, such reduction in pulse width $T_W$ is automatically performed according to the scanning format. In accordance with the present invention, a pulse train having pulse width $T_W$ which is substantially in inverse proportion to $f_H^2/fV$ (or to $f_H^2$ when fv is constant) is used as the longitudinal line signal, where $f_H$ is the horizontal scanning frequency and fv is the vertical scanning frequency. Since $T_H=1/f_H$ and $N=f_H/fv$, substituting these equations into $T_W \propto 1/(f_H^2/fv)$ proves that $T_W \propto T_H/N$.

Figure 2:
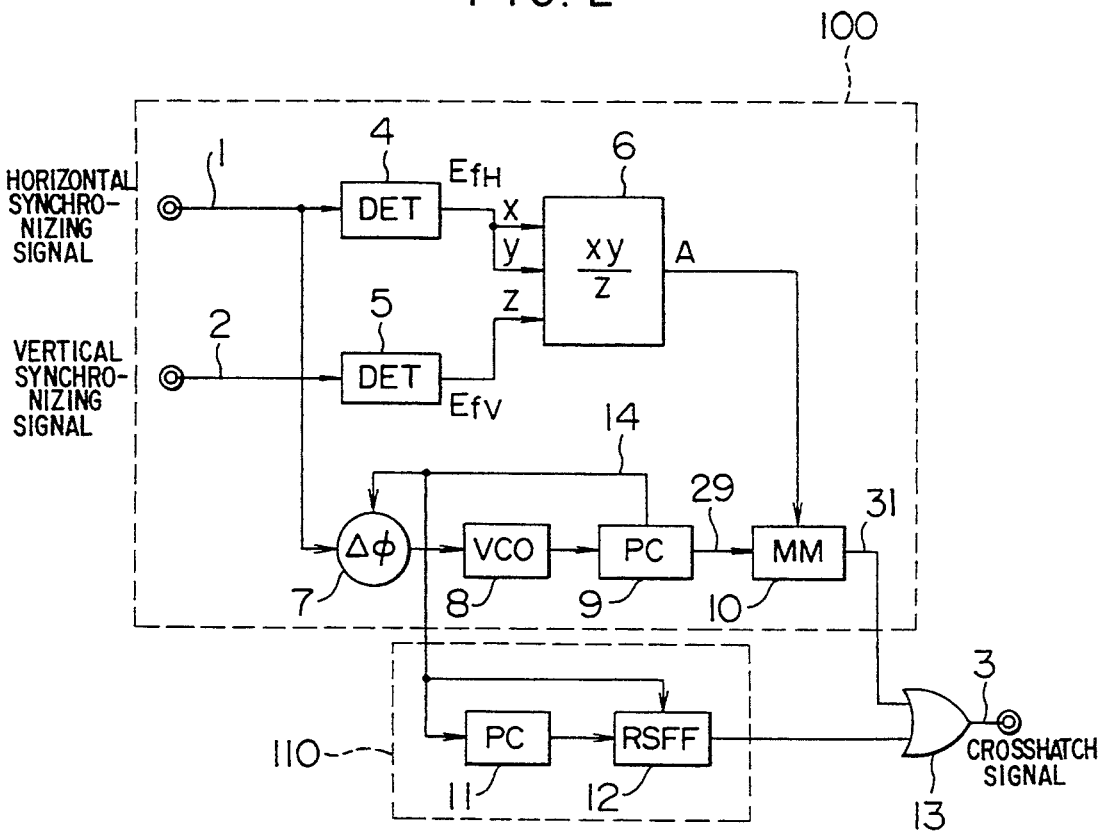
FIG. 2 is a block diagram showing an embodiment of the present invention.

FIG. 2 shows an embodiment of the present invention. In FIG. 2, numeral 100 denotes a longitudinal line signal generating section and numeral 110 denotes a lateral line signal generating section. In the longitudinal line signal generating section 100, numeral 1 denotes an input horizontal synchronizing signal, 2 an input vertical synchronizing signal, 3 an output crosshatch signal. A principal part of the present invention comprises blocks 4, 5, 6 and 10 to be described later. First of all, the remaining part will be described. Numeral 7 denotes a phase detector and numeral 8 denotes a voltage-controlled oscillator. Numeral 9 denotes a counter for providing pulses having a horizontal frequency (15 kHz to 80 kHz) equivalent to that of the input 1 at an output 14 thereof. That is to say, blocks 7, 8 and 9 serve as a well-known PLL loop. At a frequency equivalent to, say, approximately 16 times the horizontal frequency, the counter 9 generates trigger pulses 29 for generating crosshatch longitudinal lines at another output thereof to control a succeeding monostable multivibrator 10. As will be described later, the output pulse width of the output pulses 31 of the monostable multivibrator 10 is substantially in inverse proportion to the other input signal A thereof. In the lateral line signal generating section 110, numeral 11 denotes a programmable counter, which receives the input horizontal pulses 14,and outputs pulses obtained by performing frequency division with a factor of predetermined number of lines. The output pulses are used to generate the lateral line signals of the crosshatch pattern. Numeral 12 denotes a set-reset flip-flop, which receives the output of the programmable counter 11 and the horizontal pulses 14 and outputs a pulse having a pulse width equivalent to the horizontal period. Numeral 13 denotes an OR gate, which produces the logical sum of the outputs of the monostable multivibrator 10 and the flip-flop 12 as a crosshatch signal, longitudinal lines and lateral lines of a crosshatch pattern thus being combined.

Figure 3:
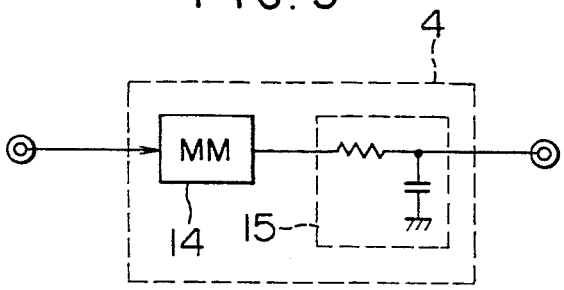
FIG. 3 is a detailed drawing of a frequency detector 4 shown in FIG. .

The principal part of the present invention will now be described. Numeral 4 denotes a frequency detector for providing a voltage $E_{fH}$ proportionate to the horizontal scanning frequency $f_H$ at the output thereof, whereas numeral 5 denotes a frequency detector for providing a voltage $E_{fv}$ proportionate to the vertical scanning frequency fv at the output thereof. As shown in FIG. 3, each of the frequency detectors (discriminators) can be implemented by combining a monostable multivibrator 14 and a low-pass filter 15.

The output pulse width of the monostable multivibrator 14 is chosen so as to be constant and chosen so as not to exceed the minimum value of the repetition period of the input pulse signal in order to prevent the duty ratio of the output pulse from exceeding 100% even when the repetition period is at its minimum value. For use in the frequency detector 4 of FIG. 2, therefore, the output pulse width of the monostable multivibrator 14 is chosen so as not to exceed 12.5 μsec correspondingly to $f_H$=15 to 80 kHz. For use in the frequency detector 5, the output pulse width of the monostable multivibrator 14 is chosen so as not to exceed approximately 8 msec correspondingly to fv=40 to 120 Hz. The time constant $\tau$ of the low-pass filter 15 is chosen so as to be approximately 20 times the largest period of the input signal, with smoothing being thus performed. An example of the multiplying and dividing unit 6 is shown in FIG. 4.

Figure 4:
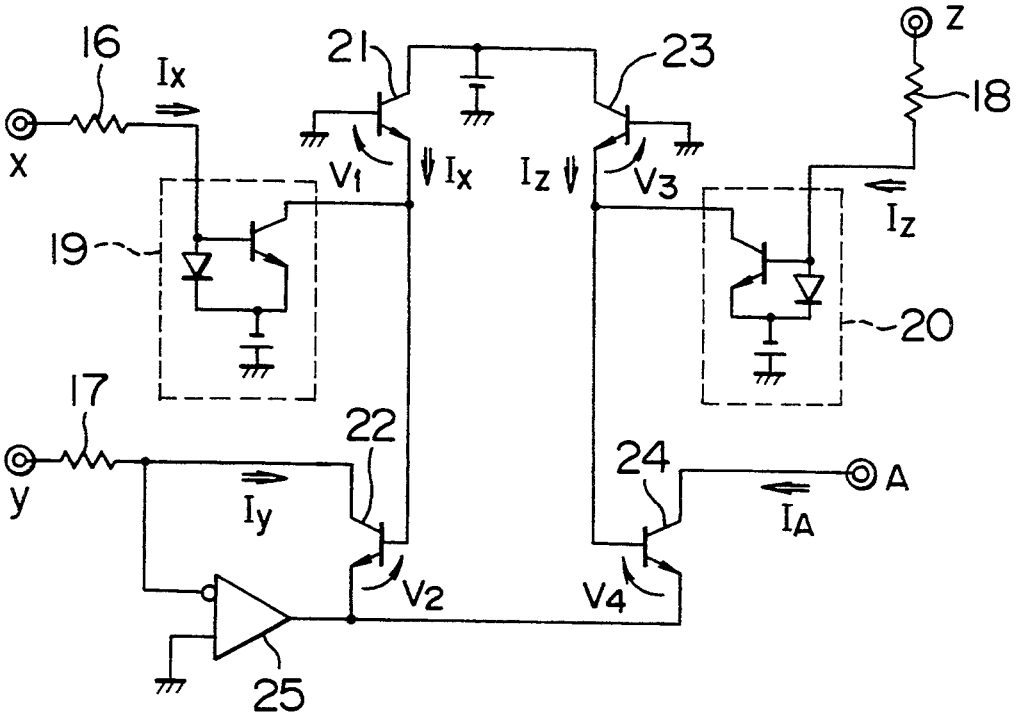
FIG. 4 is a detailed drawing of a multiplying and dividing unit 6 shown in FIG. 2.

In FIG. 4, numerals 16, 17 and 18 denote resistors respectively for converting voltages x, y and z into current sources. Numerals 19 and 20 denote current mirror circuits. Numerals 21, 22, 23 and 24 denote transistors. Respective collector currents Ix, Iy, Iz and $I_A$ of the transistors 21, 22, 23 and 24 are respectively related to respective base-emitter potential differences $V_1$, $V_2$, $V_3$ and $V_4$ as $$\left.\begin{aligned} \log Ix &\propto V_1 \\ \log Iy &\propto V_2 \\ \log Iz &\propto V_3 \\ \log I_A &\propto V_4. \end{aligned}\right\} \quad (1)$$

Numeral 25 denotes an operational amplifier having an output of current source form. The operational amplifier 25 performs negative feedback operation so that its input terminal may become nearly 0 V. As a result, the collector current Iy has a value obtained by dividing the input voltage y by the resistance value of the resistor 17.

From the configuration of FIG. 4, the following relation is obtained.

$$V_1+V_2=V_3+V_4 \quad (2)$$

Hence $$\log Ix+\log Iy=\log Iz+\log I_A$$

Finally, $$I_A=\frac{IxIy}{Iz} \quad (3)$$

Therefore, the desired multiplication output is obtained at an output terminal A.

Figure 5:
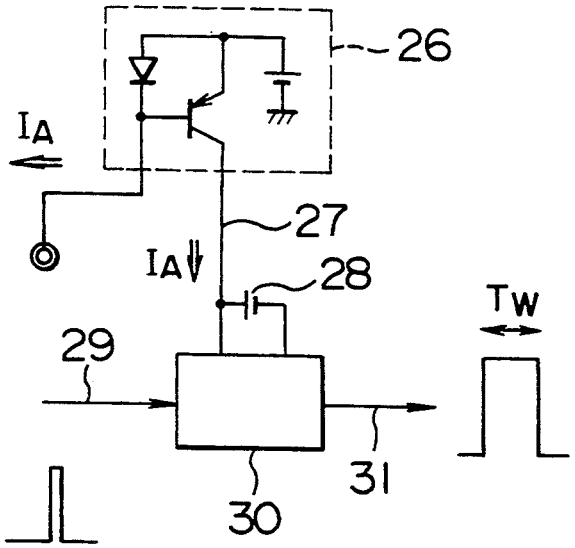
FIG. 5 is a detailed drawing of a monostable multivibrator 10 shown in FIG. 2.

Although shown in FIG. 2 in brevity, the above described output A controls the monostable multivibrator 10 as shown in FIG. 5. In FIG. 5, numeral 26 denotes a current mirror circuit, 27 a sawtooth wave generation terminal of the monostable multivibrator, 28 a capacitor, 29 a trigger input pulse which, for example, may come from programmable counter 9 as shown in FIG. 2, 30 a part of the monostable multivibrator, and 31 an output of the monostable multivibrator. The output pulse width $T_W$ has a value inversely proportional to the current 27 at the terminal 27. Because, the gradient of volt/sec of the sawtooth wave obtained at the terminal 27 is in inverse proportion to $I_A$.

Therefore, the following relation holds true.

$$T_W \propto \frac{1}{I_A} \propto \frac{Iz}{IxIy} \propto \frac{fv}{f_H^2} \quad (4)$$

Assuming now that the horizontal scanning period is $T_H$ and the number of scanning lines is N, the following relations are obtained.

$$T_H=\frac{1}{f_H},\ N=\frac{f_H}{fv} \quad (5)$$

By substituting the expression (5) into the expression (4), $$T_W \propto \frac{T_H}{N} \quad (6)$$

The right side of the expression (6) is the quotient of the horizontal period divided by the number of scanning lines. Multiplying this by a proportional constant representing a suitable aspect ratio yields a desired pulse width. In case the aspect ratio remains at unity and only the scanning frequency format changes, it is a matter of course that a change in aspect ratio need not be considered. Automatically following the changes in $f_H$ and fv according to the input signal format, the pulse width becomes suitable for displaying a longitudinal line signal having a width substantially equal to the distance between adjacent scanning lines.

In FIG. 2, the lateral line signal generating section comprises the programmable counter 11 and the flip-flop 12. However, it is evident that this section may be constituted as another PLL loop based upon the input vertical synchronizing signal 2. By doing so, such a crosshatch signal that a predetermined number of lateral lines are automatically displayed all the times irrespective of the scanning format is obtained.

Figure 6:
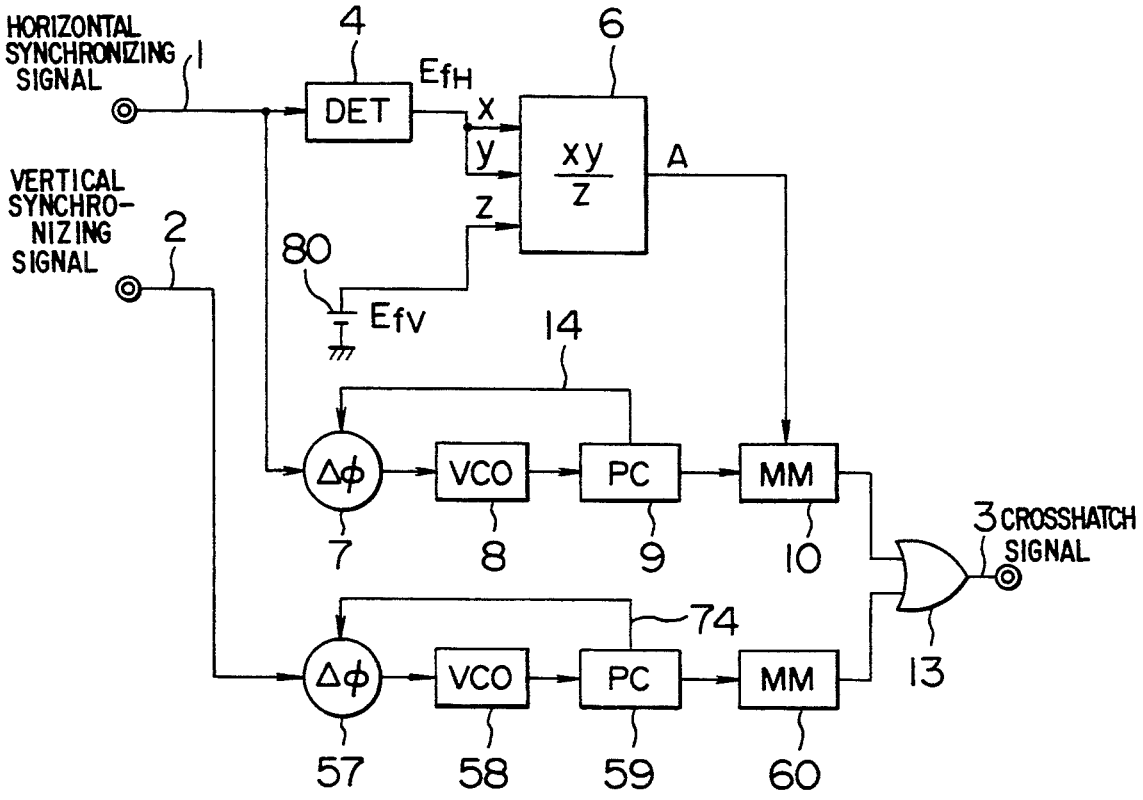
FIG. 6 is a block diagram showing another embodiment of the present invention.

FIG. 6 shows an embodiment wherein the lateral line signal generating section comprises a PLL. Numeral 57 denotes a phase detector, and numeral 58 denotes a voltage-controlled oscillator. Numeral 59 denotes a programmable counter, which produces, at an output 74 thereof, pulses having a vertical frequency equivalent to the vertical synchronizing signal 2. That is to say, blocks 57, 58 and 59 function as a PLL loop. The counter 59 produces, at another output, trigger pulses for generating lateral line signals of the crosshatch pattern, at a frequency equivalent to a predetermined number (e.g. about 8 to 16 ) times the vertical scanning frequency. A monostable multivibrator 60 located at the succeeding stage is controlled by the trigger pulses. The width of the output pulse of the monostable multivibrator is set at one horizontal scanning interval $T_H$. In the same way as the embodiment of FIG. 2, the output of the monostable multivibrator 60 is supplied to one input of an 0R gate 13.

In a range of input signal format such that fv is constant and only $f_H$ changes, the frequency detector 5 of FIG. 2 can b omitted. That is to say, instead of the frequency detector 5, a voltage source 80 having a voltage value $E_{fv}$ corresponding to the vertical scanning frequency fv is connected to the multiplying and dividing unit 6 as shown in FIG. 6.

In the embodiments of FIGS. 2 and 6, the multiplying and dividing unit 6 is constituted by using hardware. However, the multiplying and dividing unit 6 may be implemented by using a microcomputer. In this case, however, the frequency detectors 4 and 5 are replaced by counters, and counts of the horizontal and vertical synchronizing signals are fed to the microcomputer.

Owing to the present invention, a crosshatch signal having a longitudinal line width always substantially equivalent to the distance between adjacent scanning lines can be generated by using simple configuration irrespective of input signal format.

We claim:

1. An adaptive crosshatch signal generator for generating a crosshatch signal comprising:

means for generating a longitudinal line signal used to generate longitudinal lines of a crosshatch pattern;

means for generating a lateral line signal used to generate lateral lines of said crosshatch pattern; and means for deriving a logical sum of said longitudinal line signal and said lateral line signal and outputting said logical sum as said crosshatch signal;

said longitudinal line signal generating means including:

means for receiving a horizontal synchronizing signal;

means, connected to said receiving means, for detecting a horizontal scanning frequency of said horizontal synchronizing signal; and pulse processing means for controllably producing, based upon at least one output of said detecting means, output pulses each having an output pulse width which is substantially inversely proportional to the square of said horizontal scanning frequency, the output pulses produced by said pulse processing means form said longitudinal line signal.

2. An adaptive crosshatch signal generator according to claim 1, wherein said pulse processing means includes squaring means, connected to said detecting means, for squaring said horizontal scanning frequency; and first pulse generating means, responsive to said squaring means, for generating output pulses which each have a pulse width controlled so as to be substantially in inverse proportion to the output of said squaring means, wherein the output generated by said first pulse generating means forms said longitudinal line signal.

3. An adaptive crosshatch signal generator according to claim 2, wherein said first pulse generating means includes a variable pulse width multivibrator controlled to generate output pulses having a variable pulse width.

4. An adaptive crosshatch signal generator according to claim 3, wherein said first pulse generating means includes second pulse generating means for generating, based on said horizontal synchronizing signal, pulses at an interval corresponding to longitudinal line interval of said crosshatch pattern, and said multivibrator is triggered by said pulses generated by said second pulse generating means.

5. An adaptive cross-hatch signal generator according to claim 4, wherein said second pulse generating means includes a phase-locked loop responsive to said horizontal synchronizing signal for generating pulses at an interval corresponding to said longitudinal line interval.

6. An adaptive crosshatch signal generator according to claim 1, wherein said lateral line signal generating means includes counter means for performing frequency division with respect to said horizontal scanning frequency; and means, responsive to an output of said frequency counter means, for generating pulses which each have a pulse width equivalent to a horizontal scanning period as said lateral line signal.

7. An adaptive crosshatch signal generator according to claim 1, wherein said lateral line signal generating means includes means for multiplying the frequency of a vertical synchronizing signal by a predetermined number; and means, responsive to said frequency multiplying means, for generating pulses which each have a pulse width equivalent to a horizontal scanning period as said lateral line signal.

8. An adaptive crosshatch signal generator for generating a crosshatch signal comprising:

means for generating a longitudinal line signal used to generate longitudinal lines of a crosshatch pattern means for generating a lateral line signal used to generate lateral lines of said crosshatch pattern; and means for deriving a logical sum of said longitudinal line signal and said lateral line signal and outputting said logical sum as said crosshatch signal;

said longitudinal line signal generating means including:

means for receiving a horizontal synchronizing signal means, connected to said receiving means, for detecting a horizontal scanning frequency of said horizontal synchronizing signal;

squaring means, connected to receive a detected output derived by said horizontal scanning frequency detecting means, for squaring said detected output; and pulse processing means, responsive to an output of said squaring means, for producing output pulses which are each controlled so as to have an output pulse width substantially inversely proportional to the output of said squaring means, wherein the output pulses produced by said pulse processing means form said longitudinal line signal.

9. An adaptive crosshatch signal generator according to claim 8, wherein said pulse processing means includes a variable pulse width multivibrator controlled to generate output pulses having a variable pulse width.

10. An adaptive crosshatch signal generator according to claim 9, wherein said pulse processing means further includes first pulse generating means for generating, based on said horizontal synchronizing signal, pulses at an interval corresponding to a longitudinal line interval of said crosshatch pattern, and said multivibrator is triggered by said pulses generated by said first pulse generating means.

11. An adaptive crosshatch signal generator according to claim 10, wherein said first pulse generating means includes a phase-locked loop, responsive to said horizontal synchronizing signal, for generating pulses at an interval corresponding to said longitudinal line interval

12. An adaptive crosshatch signal generator for generating a crosshatch signal comprising:

means for detecting a horizontal scanning frequency of a horizontal synchronizing signal and outputting a first signal proportional to said horizontal scanning frequency;

squaring means, responsive to said first signal, for outputting a second signal representing the square of said horizontal scanning frequency;

longitudinal line signal generating means, responsive to said horizontal synchronizing signal and said second signal, for successively generating first pulses each having a pulse width inversely proportional to said square of said horizontal scanning frequency at an interval corresponding to a longitudinal line interval of a crosshatch pattern as a longitudinal line signal;

lateral line signal generating means for successively generating, based on one of a vertical synchronizing signal and said horizontal synchronizing signal, second pulses each having a time width corresponding to a horizontal scanning period at an interval corresponding to a lateral line interval of said crosshatch pattern as a lateral line signal; and means for deriving a logical sum of said longitudinal line signal and said lateral line signal and outputting the logical sum as said crosshatch signal.

13. An adaptive crosshatch signal generator according to claim 12, wherein said longitudinal line signal generating means includes pulse means, responsive to said horizontal synchronizing signal, for successively generating third pulses at an interval corresponding to said longitudinal line interval, and means, responsive to said third pulses, for successively generating said first pulses.

14. An adaptive crosshatch signal generator according to claim 13, wherein said pulse means includes a phase-locked loop, and said longitudinal line signal generating means includes a variable pulse width multivibrator controlled to generate output pulses having a variable pulse width.

15. An adaptive crosshatch signal generator for generating a crosshatch signal comprising:

means for detecting a horizontal scanning frequency of a horizontal synchronizing signal and outputting a first signal proportional to said horizontal scanning frequency;

means for detecting a vertical scanning frequency of a vertical synchronizing signal and outputting a second signal proportional to said vertical scanning frequency;

means, connected to receive said first and second signals, for outputting as a third signal a signal proportional to a quotient obtained by dividing the square of said horizontal scanning frequency by said vertical scanning frequency;

longitudinal line signal generating means, responsive to said third signal and said horizontal synchronizing signal, for generating as a longitudinal line signal first pulses each having a pulse width substantially in inverse proportion to said quotient at an interval corresponding to longitudinal line interval of a crosshatch pattern;

lateral line signal generating means for generating as a lateral line signal, based on one of said vertical synchronizing signal and said horizontal synchronizing signal, second pulses each having a width corresponding to a horizontal scanning interval at an interval corresponding to a lateral line interval of the crosshatch pattern; and means for deriving a logical sum of said longitudinal line signal and said lateral line signal and outputting the logical sum as said crosshatch signal.

16. An adaptive crosshatch signal generator according to claim 15, wherein said longitudinal line signal generating means includes pulse means, responsive to said horizontal synchronizing signal, for successively generating third pulses at an interval corresponding to said longitudinal line interval, and means, responsive to said third pulses, for generating said first pulses.

17. An adaptive crosshatch signal generator according to claim 16, wherein said pulse means includes a phase-locked loop, and said pulse generating means responsive to said third pulses for generating said first pulses includes a variable pulse width multivibrator for generating output pulses having a variable pulse width.

* * * * *